US005427651A

United States Patent [19]

Lindahl

[11] Patent Number: 5,427,651

[45] Date of Patent: Jun. 27, 1995

[54] METHOD FOR PRODUCING BLEACHED SULFATE PULP HAVING A LONG FIBER FRACTION AND A SHORT FIBER FRACTION

[75] Inventor: Jonas A. I. Lindahl, Domsjo, Sweden

[73] Assignee: Mo Och Domsjo Aktiebolag, Ornskoldsvik, Sweden

[21] Appl. No.: 877,164

[22] PCT Filed: Jan. 11, 1991

[86] PCT No.: PCT/SE91/00020

§ 371 Date: Jul. 2, 1992

§ 102(e) Date: Jul. 2, 1992

[87] PCT Pub. No.: WO91/10774

PCT Pub. Date: Jul. 25, 1991

[30] Foreign Application Priority Data

Jan. 15, 1990 [SE] Sweden ..... 9000120

[51] Int. Cl.[6] ..... D21D 5/02

[52] U.S. Cl. ..... 162/55; 162/261

[58] Field of Search ..... 162/55, 65, 129, 130, 162/24, 261, 25; 241/28

[56] References Cited

U.S. PATENT DOCUMENTS

| | | | |
|---|---|---|---|
| 3,830,688 | 8/1974 | Mannbro | 162/65 |
| 4,562,969 | 1/1986 | Lindahl | 162/55 |
| 4,776,926 | 10/1988 | Lindahl | 162/55 |
| 4,781,793 | 11/1988 | Halme | 162/55 |

FOREIGN PATENT DOCUMENTS 83004606 2/1988 Sweden .

OTHER PUBLICATIONS

Lindqvist, B. et al., "Nitrogen Dioxide . . . for the Future?", Journal of Pulp & Paper Science, vol. 12, No. 6, pp. J161–165, Nov. 1986.

Tasman J. E., "The Fiber Length of Bauer–McNett Screen Fractions", TAPPI, Jan. 1972, vol. 55, No. 1, pp. 136–138.

Avändningsområden.

"Blekning," *Yrkesbok,* Y–208, 1978.

Derwent Abstract of Swedish Patent Specification No. 6300460–6, Feb. 1, 1988.

English language version of the measuring method SCAN–M6:69 discussed in "Fiberfraktionering av mekanisk massa med McNett–apparat" (Fiber Fractionation of Mechanical Pulp in the McNett Apparatus), *Scandinavian Pulp, Paper and Board,* SCAN–M6:69, 1969.

Fredriksson, B., et al., "Chemithermomechanical Pulps in Different Paper Grades," *Applta,* vol. 31, No. 5, Mar. 1978.

"Blekning—Kemisk massa," *ANKOM,* STFI—meddelande Serie D Nr 266, Oct. 1986.

*Primary Examiner*—Steve Alvo

*Assistant Examiner*—Dean T. Nguyen

*Attorney, Agent, or Firm*—Sughrue, Mion, Zinn, Macpeak & Seas

[57] ABSTRACT

A method for producing bleached sulfate pulp comprising the steps of:

(1) conducting an initial bleaching of a sulfate pulp, wherein the pulp is manufactured by a sulfate process from softwood, with at least one non-chlorine-containing bleaching agent, the initial bleaching comprising one or more consecutive stages, (2) during step (1), lowering the kappa number of the pulp to below 12, while permitting the limit viscosity to fall below 900 $cm^3/g$, (3) fractionating the pulp prior to or at a time subsequent to step (1) to obtain:

(a) a long fiber fraction comprising fibers, wherein less than 10% by weight of the fibers pass through 200 mesh and greater than 60% by weight of the fibers are retained on 30 mesh, wherein the long fiber fraction has a shive content of less than 0.05% by weight, and (b) a short fiber fraction comprising fibers, wherein less than 40% by weight of the fibers are retained on 30 mesh and greater than 10% by weight of the fibers pass through 200 mesh, wherein the short fiber fraction has a shive content of substantially 0% by weight, and a corresponding method for manufacturing a paper product from the thus produced bleached sulfate pulp.

2 Claims, No Drawings

METHOD FOR PRODUCING BLEACHED SULFATE PULP HAVING A LONG FIBER FRACTION AND A SHORT FIBER FRACTION

This invention relates to novel cellulose pulps having abnormal fibre-size distribution, and also to the use of said pulps in the manufacture of paper, including writing and printing paper, paperboard, soft paper, absorption pulp and other products in which cellulose fibres are included. The pulps are primarily produced by sulphate cooking of softwood, and bleaching the pulp to brightnesses from 45% ISO and higher (normally beneath 95% ISO) (SCAN-C 11:75). The pulp can be manufactured with environmentally-friendly methods embraced by the invention.

The expressions pulp and cellulose pulp are used synonymously in the present document and refer to cellulose fibre material with or without lignin.

In the manufacture of bleached cellulose pulps, efforts are made to remove lignin, resin, etc. In order for cellulose pulps to be suitable for the manufacture of paper products, it is considered that their limit viscosities shall be greater than 900 $cm^3/g$ (In description and claims it is intended, that the limit viscosity is measured in accordance with SCAN-C 15:62). However, the most important criterion is that when the pulp is beaten in a PFI-mill, the pulp will behave in an acceptable manner with regard to such properties as beating degree development (°SR, SCAN-C 19:65) and changes in density ($kg/cm^3$, SCAN-P 7:75), tensile index (Nm/g, SCAN-P 38:80) and tear index ($mNm^2/g$. SCAN-P 11:73) and that tear index and surface roughness (Bendtsen ml/min, a given manner. In the majority of cases, the beating degree, i.e. °SR, shall increase as little as possible during the beating process.

The requirements on mentioned properties are contingent on the use and the type of pulp concerned. Thus, the demands are mutually different for sulphate pulp, groundwood pulp, thermomechanical pulp, sulphite pulp etc.

In the case of bleaching softwood sulphate pulp, e.g. with oxygen gas, it has been considered that good paper properties are incompatible with limit viscosities beneath 900 $cm^3/g$. Subsequent to cooking, the kappa number of the pulp (washed and screened) is normally between 20–40. In order to manage the viscosity and to remove further lignin, bleaching has therefore been carried out in stages with different bleaching chemicals. An example of this is $HClO/ClO^-$, $Cl_2$, $O_2$, $O_3$, $ClO_2$, $H_2O_2$, $BH_4^-$, $S_2O_4^-$, $NO_2$ etc., each of which requires its own specific conditions (e.g. different pH-values and the addition of cellulose protectors). $NO_2$ is directed primarily to activation of pulp with $NO_2$ (in the presence of $H^+$and $NO_3^-$) and optionally in the presence of oxygen gas, so as to convert formed NO to $NO_2$. Chlorine is a classic bleaching chemical, although it has the drawback of producing chloro-organic compounds which are considered to be toxic. Chloro-organic compounds which remain in the pulp subsequent to processing the pulp can result in degradation of cellulose and yellowing. It is normal to classify the bleaching agents as chlorine-containing and non-chlorine containing substances. Another method of classification is reducing bleaching agents and oxidizing bleaching agents. Of the aforesaid bleaching agents, $BH_4^-$and $S_2O_4^{2-}$ are reducing, whereas the remainder are oxidizing.

There has long been an interest to fractionate and to study the properties of the different pulp fractions obtained. These studies have been directed primarily to so-called high yield pulps. i.e. thermomechanical pulp (TMP), stone groundwood pulp (SGW), chemithermomechanical pulp (CTMP), etc. Fractionation has been carried out industrially in screen rooms and has involved the enrichment of long fibres and also of so-called shives, which subsequent to treatment in a disc refiner are again mixed with the original pulp. Fractionation has also been carried out with the intention of producing two mutually different pulp qualities from one original pulp (one quality with longer fibres and one quality with shorter fibres). For the fractionation of high yield pulps, see BE-B-444 825, 441 282 and 435 941. For the fractionation of other types of pulp, see for instance GB-A1 402 516, U.S. Pat. Nos. 1,809,312 and 4,781,793. SE-A-8300460-6 describes a manner of producing readily-defibered fluff pulp by removing the major part of the fine material from, for example, softwood sulphate pulp, i.e. that material which passes through mesh 200 according to ASTM.

It has now been found that it is possible to produce from softwood, via sulphate cooking for instance, cellulose pulps which, subsequent to being beaten, fulfil current requirements for the manufacture of paper while, at the same time accepting a lower value of the limit viscosity, such as down to 600 $cm^3/g$. Since the important properties utilized in the manufacture of paper are in the same class as conventional softwood sulphate, the inventive cellulose pulps can be used in the manufacture of paper without impairing quality to any appreciable extent. It has also been found possible to obtain from softwood sulphate pulp cellulose pulps which are able to replace short-fibre hardwood sulphate pulp in the manufacture of paper.

The inventive pulp types can be produced by novel combinations of known techniques applied to cellulose pulp of the softwood sulphate type. The use of novel techniques for the manufacture of said pulps is not excluded, however.

One object of the invention is to provide strong softwood sulphate cellulose pulps which can be used in the manufacture of different types of paper and which are also able to replace earlier known pulps intended for the same purpose.

A second embodiment of the invention is to provide softwood sulphate pulps which are manufactured in accordance with environmentally friendly methods with the use of a minimum amount of elementary chlorine, or with no chlorine at all.

A third object of the invention is to provide softwood sulphate pulps which potentially have a low content of water-insoluble, chloro-organic compounds, these pulps also having a low yellowing tendency.

Further object of the invention is to provide environmentally friendly processes for the manufacture of the novel inventive pulps.

The inventive softwood sulphate cellulose pulps are characterized in that their kappa numbers are beneath 12, preferably beneath 10, and even more preferably beneath 8. In the case of the inventive pulp qualities of the highest interest commercially, the kappa number is substantially 0, i.e. 0–0.5 (fully bleached, finally bleached pulps). In description and claims it is intended that kappa numbers shall be measured according to SCAN-C 1:59. A pulp according to the invention is also characterized in that its content of fibres which pass through a wire of mesh size 200 mesh according to Bauer McNett is less than 10, such as less than 5% by weight of the total fibre weight of the pulp, and that the content of fibres which fasten on 30 mesh is above 60, such as above 70% by weight (long fibre fraction, higher proportion of long fibres than in standard softwood sulphate pulps). In accordance with one alternative embodiment, the content of fibres retained on 30 mesh according to Bauer McNett is beneath 40, such as beneath 30% by weight, and the proportion of fibres which pass through 200 mesh is above 10, such as above 15% by weight (short fibre fraction, higher proportion of short fibres than in standard softwood sulphate pulp). The percentage values recited in this paragraph are calculated on total fibre weight in respective pulps (=fractions). The percentage values are determined according to SCAN-M 6:69. The shire content of the long fibre fraction is <0.05% and in the short fibre fraction is substantially 0% (i.e. <0.01%) (Sommerville).

Another characteristic is that the limit viscosity of the pulps is above 600 $cm^3/g$ but below 900 $cm^3/g$. The inventive long fibre fraction is a cellulose pulp which can be obtained with unexpectedly high strength in relation to its viscosity. Thus, the tear index (SCAN-P 11:75) of the pulp can be greater than 6 $mNm^2/g$, such as greater 5 than 7 $mNm^2/g$ after beating at 4000 revolutions in a PFI-mill.

The inventive cellulose pulps are produced with the aid of a novel combination of conventional bleaching and fractionating methods. Subsequent to digestion of the wood (lignocellulosic material) via, for instance, the sulphate process, and optionally defibered, washed and screened, the inventive cellulose pulps can be obtained via different bleaching sequences. The basic sequence is a single or multistage bleaching sequence involving oxidative or reductive bleaching with known bleaching chemicals (see above). In order to facilitate delignification and treatment for stabilizing the cellulose molecule, respective stages may be interspersed with washing stages, optionally alkaline washing stages. Examples of popular bleaching sequences are: O—C—E—D—D, $NO_x$—O—D—E—D—D, where O is oxygen, C is chlorine, E is an alkali extraction (for instance NaOH), D is chlorine dioxide, $NO_x$ signifies treatment with oxides of nitrogen active in the delignification process.

The combination of bleaching and fractionating defines the inventive method. This aspect of the invention thus relates to processing or upgrading cellulose pulp subsequent to digesting the wood. This processing is characterized by:

(i) via a bleaching sequence comprising one or more consecutive, initial bleaching stages lowering the kappa number of the pulp to beneath 12, such as beneath 10 or lower in the initial bleaching stage or stages, with the aid of a non-chlorine containing oxidizing bleaching agent, in a known manner, and (ii) introducing prior to, during or subsequent to the bleaching sequence a separate treatment in which the pulp is fractionated so as to obtain a long fibre fraction and a short fibre fraction, and ensuring that respective fractions obtain a fibre composition which coincides with the aforesaid definitions of the inventive cellulose pulps.

As mentioned in paragragh (i) above, the bleaching sequence preferably Includes one or two initial, consecutive stages. The bleaching agent may be $O_2$ in said one or in both of these stages. One variant which is potentially of future interest is that one of the initial stages utilizes so-called activation of the cellulose pulp, implying that the pulp is contacted with nitrogen dioxide, hydrogen ions and nitrate ions and optionally oxygen gas (in order to convert formed nitrogen monoxide to nitrogen dioxide), preferably followed by a separate $O_2$-stage. By utilizing active nitrogen oxides in this way, in combination with $O_2$ in the subsequent stage, it is possible to achieve kappa numbers of 8 and lower (such as beneath 5), while maintaining the viscosity of the bleached pulp within the framework of the invention at the same time. In general, the reduction in kappa number with the aid of non-chlorine-containing bleaching agents in these initial stages shall be in total more than about 45% of the kappa number of the pulp after cooking and washing. As mentioned above, the pulp can be bleached with other bleaching agents subsequent to being treated in the inital stage/stages.

It may be suitable, for practical reasons, to place the fractionating stage at the end of a bleaching sequence, for instance after the last bleaching stage. This does not exclude the possibility of fractionating the pulp prior to or subsequent to an initial bleaching stage. When choosing the position of the fractionating stage, it should be observed that the fractionating process should preferably take place with a pulp consistency of 0.5–5%, i.e. suitably in conjunction with screening the pulp.

Fractionation is effected in conventional screen rooms builded up, for instance, of vibratory, pressure and centrifugal screens, and, among other things, by adapting the flows, hole sizes and slot widths it is possible to obtain, in manners known in screening operations, fractions which fulfil the fibre-size distribution of the inventive cellulose pulps. See, for instance, Wochenblatt für Papierfabrikation 30 (1988) pages 883–892.

Subsequent to finally bleaching, dewatering and drying the inventive pulp, it is optionally diluted or thinned to a desired dry solids content and pulp consistency respectively. Thus, the dry solids content can be varied between 0.5–95.5% by weight. In the case of pump pulp in integrated paper mills, this pulp consistency will be 0.5–5% by weight, whereas for retail pulp the dry solids content will be 85–95.5% by weight.

Depending on the manufacturing method employed (e.g. bleaching sequence), the inventive pulps can be obtained with varying contents of non-cellulose material. In particular, pulps produced in accordance with the inventive method are characterized by their content of water-insoluble chlorine compounds, determined as the chlorine content of the pulp subsequent to being leached with water that contains nitrate (Stevens B Jet al; Tappi Journal 181–3 [1989]). In accordance with the invention, this chlorine content is normally beneath 300 milligrams per kilo of dry pulp in respect of both the long fibre and short fibre fraction, and in the case of the preferred embodiments, this content can be lowered to beneath 200 milligrams per kilo of dry pulp, such as in the range of 50–200 milligrams per kilo of dry pulp, or beneath 50 milligrams per kilo of dry pulp (contents measured according to Stevens B Jet al). One rule which normally applies is that if a long fibre fraction and a short fibre fraction originate from one and the same original pulp, the chlorine content is higher in the latter, e.g. 1–25% by weight larger.

The inventive pulps can be used for the manufacture of paper, including paperboard. The cellulose pulp concerned is beaten according to requirements, and then mixed with the stock aimed for the paper web to be formed. The stock may include cellulose pulps from mutually different types of wood, for instance hardwood pulp and also different types of pulp, such as sulphite pulp, chemithermomechanical pulp (CTMP), Thermomechanical pulp (TMP), and stone groundwood pulp (SGW), etc. The invention has a wide area of potential use (cf U.S. Pat. No. 4,781,793) in the manufacture of paper, including paperboard, which comprises several fibre layers, where respective layers include cellulose pulps with mutually different fibre-size distribution. This is because when practising the present invention a long fibre pulp and a short fibre hardwood-sulphate-like pulp can be obtained from one and the same softwood sulphate cook.

Similar advantages are also obtained in the manufacture of paper in which the fibre material normally comprises a mixture of hardwood and softwood sulphate pulp. Preliminary tests indicate that the one of the inventive pulps which have an elevated short fibre content may not need to be beaten when used in paper in homogenous admixture with cellulose pulps of a long-fibre wood type. This results in an energy saving as high as at least 10%.

Examples of products in which the inventive cellulose pulps can be used are wood-containing and wood-free paper, such as magazine paper, fine paper, paperboard (homogenous paperboard, folding boxboard and liner), soft paper, fluff, insulating materials, etc.

The invention is illustrated in the following examples and is further defined in the following claims, which constitute part of the description.

EXAMPLES

Reference

Pine sulphate pulp, having kappa number 26.7, viscosity 1155 cm $^3$/g and DKM-extract content 0.04%, was subjected to conventional oxygen-gas delignification. Accordingly, the pulp was mixed with 2.3% NaOH at a pulp consistency of 26%. The alkaline pulp was delivered to a pressure vessel, in which the pulp was heated to 105° C. At this temperature, oxygen gas was introduced, such as the pressure in the vessel became 6 kP/cm$^2$. The reaction was interrupted after 40 minutes, by lowering the pressure to atmospheric pressure. After thinning the pulp with water to 10% pc (pulp consistency), the pH was measured and found to be 10.7. After washing with water the pulp was dried to a dry solids content of 91.0%.

Experiments in accordance with the invention

Pulp was taken from the same batch of pine sulphate pulp as that used in the reference test and was treated in accordance with the invention. In accordance with the inventive method, the pulp was admixed with 5.0% NaOH at 26% pc. The pulp was then heated in the pressure vessel to a temperature of 110° C. Oxygen gas was introduced, so as to increase the pressure to 6 kp/cm$^2$. The treatment process was interrupted after a 60 minute reaction time by reducing the overpressure. Subsequent to thinning the pulp to 10% pc, the pH was measured and found to be 9.8. The pulp was then washed with water and part of the pulp was dried to a dry solids content of 92.0%.

Both the reference pulp and the experimental pulp were analyzed according to kappa number (SCAN-C 1:77), extract content (SCAN-C 7:62) and viscosity (SCAN-C 15:62). The results are set forth in Table 1 below.

Non-dried pulp (A) produced in accordance with the invention was thinned with water to 0.3% pc, and the resultant pulp suspension was pumped through so-called vortex cleaners in order to divide the pulp into an A-short-fibre pulp or fraction and an A-long-fibre pulp or fraction. In the experiment, the proportion of short fibres present was 15% by weight (calculated on the weight of the ingoing pulp), whereas the proportion of the enriched long fibres was 85% by weight. The resultant pulps were analyzed with respect to their kappa number, extract content and viscosity. The results are set forth in Table 1 below.

TABLE 1

| | Kappa-number | Extract content DKM % | Viscosity cm$^3$/g |
|---|---|---|---|
| Reference, $O_2$-delign. | 15.7 | 0.04 | 953 |
| $O_2$-delign. according to inv.(A) | 9.8 | 0.04 | 735 |
| A-short fibre pulp | 9.7 | 0.10 | 695 |
| A-long fibre pulp | 9.7 | 0.02 | 736 |

As will be seen from the results in Table 1, tile pulp which was $O_2$-delignified to a low kappa number obtained a far lower viscosity than the reference pulp. It will be seen at the same time that the long fibre pulp recovered from the experiment pulp had a higher viscosity than the short fibre pulp. The surprisingly low extract content of the long fibre pulp should also be noted.

Laboratory tests were carried out in order to check the paper-technical properties of the pulps. In these tests, the pulps were beaten in a PFI-mill (SCAN-C 24:67) prior to producing test sheets (SCAN-C 26:67). The more important results have been set forth in Table 2 below. Data for a birch sulphate pulp has also been included for comparison reasons.

TABLE 2

Properties subsequent to PFI-beating, 2000 beating revolutions

| | | According to inv. | | |
|---|---|---|---|---|
| | Reference $O_2$-delign. | Short fibre | Long fibre | Birch sulphate pulp |
| Beating degree °SR (SCAN-C 19:65) | 16.3 | 38.3 | 16.0 | 21.6 |
| Density, kg/m$^3$ (SCAN-P 7:75) | 740 | 783 | 733 | 825 |
| Tensile strength index Nm/g (SCAN-P 38:80) | 100 | 86 | 102 | 94 |
| Tear index mNm$^2$/g (SCAN-P 11:73) | 10.9* | 7.1 | 10.0** | 7.3 |
| Surface roughness ml/min (SCAN-P 21:67) | 197 | 60 | 220 | 76 |
| Stretch, % (SCAN-P 16:67) | 3.4 | 3.5 | 3.1 | 3.4 |

*at 4000 revs 9.7 mNm$^2$/g
**at 4000 revs 8.9 mNm$^2$/g

It will be seen immediately from the above results that it is surprisingly possible to delignify sulphate pulp from pine with oxygen gas to extremely low kappa numbers while retaining important paper properties. Of still greater interest is the fact that the short fibre fraction from the pulp of low kappa number had essentially the same properties as birch sulphate pulp.

I claim:

1. A method for producing bleached sulfate pulp wherein said sulfate pulp is manufactured by a sulfate process from softwood, said method comprising the steps of:

(1) an initially bleaching a sulfate softwood pulp with at least one non-chlorine-containing bleaching agent, a kappa number of said pulp being lowered during said initial bleaching to below 12, while a limit viscosity of said pulp falls below 900 $cm^3/g$ but above 600 $cm^3/g$, said initial bleaching comprising one or more consecutive stages, and (2) fractionating said pulp prior to or at a time subsequent to step (1) to obtain:

(a) a long fiber fraction comprising fibers, wherein less than 10% by weight of said fibers contained in said long fiber fraction pass through 200 mesh and greater than 60% by weight of said fibers contained in said long fiber fraction are retained on 30 mesh, wherein said long fiber fraction has a shive content of less than 0.05% by weight, and (b) a short fiber fraction comprising fibers, wherein less than 40% by weight of said fibers contained in said short fiber fraction are retained on 30 mesh and greater than 10% by weight of said fibers contained in said short fiber fraction pass through 200 mesh, wherein the short fiber fraction has a shive content of substantially 0% by weight.

2. The method according to claim 1, further comprising the step of dewatering and drying at least one of the pulp fractions to a dry content of 85 to 95.5% by weight subsequent to said fractionation.

* * * * *